US007338365B1

(12) United States Patent
Luciano, Jr.

(10) Patent No.: US 7,338,365 B1
(45) Date of Patent: Mar. 4, 2008

(54) INTERACTIVE POKER GAMING SYSTEM AND METHOD

(75) Inventor: Robert A. Luciano, Jr., Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 857 days.

(21) Appl. No.: 10/819,706

(22) Filed: Apr. 7, 2004

(51) Int. Cl.
*A63F 9/24* (2006.01)

(52) U.S. Cl. ..... 463/13; 463/11; 463/12

(58) Field of Classification Search ..... 463/11–13, 463/20, 25; 273/143 R, 138.1
See application file for complete search history.

(56) References Cited

U.S. PATENT DOCUMENTS 6,093,100 A 7/2000 Singer
6,129,632 A * 10/2000 Luciano ..... 463/12
6,132,311 A 10/2000 Williams
6,270,405 B1 8/2001 Ferguson
6,368,214 B1 * 4/2002 Luciano ..... 463/18
2001/0023199 A1 9/2001 Walker et al.
2002/0037762 A1 3/2002 Wood

* cited by examiner

*Primary Examiner*—Robert E. Pezzuto
*Assistant Examiner*—Robert Mosser
(74) *Attorney, Agent, or Firm*—Michael A. Kerr; Virtual Legal, LLC

(57) ABSTRACT

A system and method for playing an interactive poker game with a deck of playing cards that comprises a plurality of playing squares. Each game session comprises a plurality of game events in which one or more playing cards are drawn from a deck and transferred to one of the plurality of playing squares. The player is permitted to place a plurality of cards in each playing square, and only the top card associated with each playing square is used to determine if a winning card combination is generated. The player is awarded one or more prizes according to a dynamic paytable. For the chargeable action embodiment, the player is charged at least one credit for drawing the playing cards from the deck and transferring the playing cards to one of the playing squares. For the average bet embodiment, the player is only charged at the beginning of the game session.

47 Claims, 9 Drawing Sheets

230

| | | | |
|---|---|---|---|
| Three of a Kind 3 | Full House 9 | Four of a Kind 25 | Royal Flush 250 |
| Straight 4 | Flush 6 | Straight Flush 50 | |

FIG. 5

240

| | | | |
|---|---|---|---|
| Three of a Kind 1 | Full House 3 | Wild Royal Flush 25 | Royal Flush 500 |
| Straight 2 | Four of a Kind 4 | | |
| Flush 2 | Straight Flush 10 | Five of a Kind 15 | |

FIG. 6

INTERACTIVE POKER GAMING SYSTEM AND METHOD

CROSS REFERENCE

This patent application is related to patent application Ser. No. 10/214,862 filed on Aug. 7, 2002 which is related to patent application Ser. No. 10/041,940 filed on Oct. 17, 2001 (now abandoned) which is related to patent application Ser. No. 09/665,742 filed on Sep. 20, 2000 (now U.S. Pat. No. 6,368,214) which is related to patent application Ser. No. 09/267,126 filed on Mar. 10, 1999 (now U.S. Pat. No. 6,129,632) which is related to patent application Ser. No. 08/866,931 filed on May 31, 1997 (now abandoned), all of which are hereby incorporated by reference.

BACKGROUND

1. Field of Invention

The present invention is an interactive card based gaming system and method. More particularly, the invention is an interactive poker game in which a player is awarded a prize for having a winning hand according to a paytable.

2. Background

Traditional Poker uses a standard pack of playing cards having 52 cards and possibly more cards depending on the use of wild cards like jokers. The card ranking from highest to lowest is Ace, King, Queen, Jack, 10, 9, 8, 7, 6, 5, 4, 3, and 2. There are four suits, namely, spades, hearts, diamonds and clubs. No suit is higher than another suit. The use of Wild Cards depends on the variation of poker being played. A wild card may either be a separate card or an added card like a Joker. For example, a particular card may be specified in the standard deck to be wild like the "deuces", i.e. all different suits of the 2 card.

The number of cards is dependent on what type of poker game is being played. For example if a five card stud poker game is being played, then each player is dealt five cards, and for a seven card stud game seven cards are dealt. Each hand that is dealt is ranked to determine the award granted to the player. The best natural hand, i.e. no wild cards, is a straight flush. A straight flush is five cards in a row that are all the same suit, e.g. 7♠, 8♠, 9♠, 10♠, and J♠. The highest straight flush is a Royal Flush which is an Ace high straight flush. The second best hand is Four-of-a-Kind in which there are four cards of the same rank. If there are two or more hands, the hand with the higher rank of four wins. The third best hand is a Full House which consists of three of a kind and a pair, e.g. 7♠, 7♣, 7♦, 2♠, and 2♣. The fourth best hand is a flush which consists of a hand in which all the cards are the said suit, e.g. 2♣, 6♣, 10♣, J♣ and Q♣. The fifth best hand is a Straight which consists of five cards in a row that do not have the same suit, e.g. 2♣, 3♠, 4♦, 5♠, and 6♦. The sixth best hand is three of a kind which consists of three cards having the same rank with the remaining cards not being a pair, e.g. 7♠, 7♣, 7♦, 2♠, and 5♣. Other hands includes two pair, one pair, and high card.

In a traditional poker game the play is initiated by with an "ante" bet that provides the player with a hand of playing cards. The ante money is put in the center of the table and is referred to as the "pot". There are three choices the player has when wagering during a poker game: call, raise and fold. A "call" matches the last bet placed. A "raise" matches the last bet and increases the bet amount. A "fold" results in the player losing his hand and losing the possibility of winning the pot.

In a typical five card stud game each player puts in an ante and then receives five cards face down. A round of betting is initiated based on the cards dealt. Each player then chooses the amount of cards to discard from their respective hand. For each card discarded, the player receives a new card. Then another round of betting is initiated. After the betting, each player reveals their respective hand and the highest hand wins the pot.

The traditional poker game described above has been adapted for video. One of the most popular video games in Nevada-style casinos is Video Poker. One well known illustrative standard video poker game is the Jacks or Better video game manufactured by International Gaming Technologies, Inc in Reno, Nev. In this video poker game a player is provided with a choice of which cards to hold and which cards to discard in exchange for newer cards. The player does not play against other players, and the player optimum choices during the video poker game are dependent on the history of the cards dealt and on the paytable displayed to the player.

A plurality of patent have issued for variations of the Jacks or Better video poker game. One of these variations to video poker permit the player to simultaneously play multiple poker hands as taught by U.S. Pat. No. 6,270,405 and U.S. Pat. No. 6,132,311 which are hereby incorporated by reference. Additionally, many patents teach modifying a traditional poker such as in U.S. Pat. No. 6,093,100 "'100 patent" which is also hereby incorporated by reference. The '100 patent teaches allowing a player to sequentially build a card hand after each round of play from a pair of cards that are dealt to the player. During the game session the player selects one of the pair of cards for the card hand and discards the other card. The resulting hand is compared to a paytable to determine if the player is awarded a prize.

It shall be appreciated by those skilled in the art of gaming that traditional poker and the various video poker games are viewed by many players as a game of skill. For purposes of this patent, "player skill" includes three components: minimal skill, dexterity skill, and knowledge skill. Generally, all games include these components, however, the degree of skill varies for each game. Minimal skill requires a minimal understanding of the rules of the game and minimal dexterity needed to apply the rules of the game. To play a game according to the game rules, the player must possess minimal skill.

By way of example and not of limitation, a lottery game is a game that in principle only requires minimal skill. The minimal skill required is the selection of numbers from a card having a plurality of numbers within. The correct amount of numbers must be identified before the lottery drawing. The game outcome is theoretically random so little or no dexterity skill or knowledge skill is used. Other games that theoretically rely on random events include traditional keno and stand-alone slot machines.

Dexterity skill is based on the player's reflexes or coordination. Most games require a degree of dexterity to establish game play. Certain games such as arcade video games or pinball machines are primarily dexterity based skill games. For example, in the well-known "Pong" video game, the player removes bricks from a wall by causing a ball to "hit" the brick with a player controlled paddle. Dexterity skill is needed to ensure that the ball strikes the paddle so that the player may continue playing the game. The objective during game play is to generate as many points as possible, and this objective is generally achieved by playing the game as long as possible.

Knowledge skill is based on the player's experience and analytical abilities. Most games require a degree of knowledge skill during game play. For example, the Pong game described above requires a certain amount of knowledge skill in anticipating how the ball will bounce off the brick wall. However, this level of knowledge is minimal when compared to the level of dexterity skill.

An illustrative example of a casino-type game that uses knowledge skill is a standard video poker game of Jack or Better. In this video poker game a player is provided with a choice of which cards to hold and which cards to discard in exchange for newer cards. The optimum choice made by the player is dependent on the paytable for the video poker game. For illustrative purposes, with a paytable that pays a Royal Flush 800, a Straight Flush 50, Four of a Kind 25, a Full House 9, a Flush 6, a Straight 4, Three of a Kind 3, Two Pair 2 and a Pair of Jacks or Better 1, the player has a theoretical optimum return of 99.5%. Thus, if a player starts with a $20 bill, and wagers $1 at a rate of six games per minute, this loss rate is $1.80 per hour and on average the player could play for 11 hours before consuming all the playing funds. In the illustrative example of the standard video poker machine, the knowledge skill used by the player is dependent on the amount wagered, the cards initially dealt to the player, the cards discarded by the player, the new cards provided to the player and the paytable for compensating the player. During the game session, the player attempts to optimize his/her award according to the paytable. Since the optimal player outcome is dependent on the paytable, a "knowledgeable" player's decision will be highly dependent on the paytable. The paytable provided in the illustrative standard video poker machine is a static paytable. A static paytable does not change during game play and provides a fixed award for each award event.

It shall be appreciated by player's experienced in video poker games that video poker games requires a heightened level of knowledge based skill. This heightened level of knowledge based skill permits the player to have the opportunity to apply a variety of different strategies to maximize winnings and minimize losses. In spite of the heightened level of skill, the well known video poker games provide limited interactivity. For example, the player only has one opportunity to discard one or more cards after each hand is drawn. Additionally, even if the player has a plurality of opportunities to discard cards, the player must wait until new cards are exchanged before knowing if the player is awarded a prize. In well-known video poker games, the paytable remains static. This static paytable does not mimic a traditional poker game in which the "pot" is dynamic and changes and generally increases as the poker game continues.

SUMMARY

A method for playing an interactive poker game with a deck of playing cards that comprises a plurality of playing squares. Each game session comprises a plurality of game events in which one or more playing cards are drawn from a deck and transferred to one of the plurality of playing squares. The player is permitted to place a plurality of cards in each playing square, and only the top card associated with each playing square is used to determine if a winning card combination is generated. The player is awarded one or more prizes according to a dynamic paytable. For the chargeable action embodiment, the player is charged at least one credit for drawing the playing cards from the deck and transferring the playing cards to one of the playing squares. For the average bet embodiment, the player is only charged at the beginning of the game session.

An interactive poker gaming system comprises a player interface, a credit meter, a processor and a memory. The player interface is configured to display at least one deck of playing cards and a plurality of playing squares. The playing squares are configured to receive one or more cards from the deck of playing cards. The processor is in operative communication with the player interface and the processor is configured to determine when to award the player a prize. The memory is communicatively coupled to the processor and is configured to store a dynamic paytable that identifies prizes awarded for having the player obtain a winning poker card combination. For the chargeable action embodiment, the credit meter monitors available credits that are wagered for each chargeable action. For the average bet embodiment, the credit meter monitors available credits that are wagered at the beginning of the game session.

BRIEF DESCRIPTION OF THE DRAWINGS

Embodiments of the present invention are shown in the accompanying drawings:

FIG. 5 is an illustrative paytable for the interactive poker game without any wild cards.

FIG. 6 is an illustrative paytable for the interactive poker game with deuces wild.

DESCRIPTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Illustrative Gaming System

Figure 1:
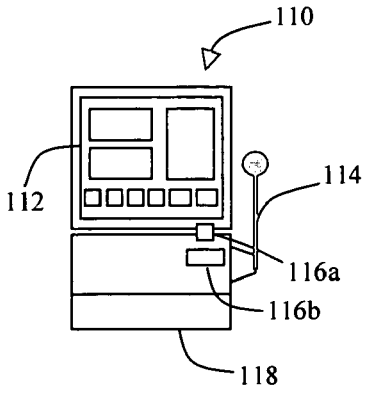
FIG. 1 is an illustrative stand-alone system for the interactive poker game.

Referring to FIG. 1 there is shown an illustrative stand-alone device 110 configured to provide an interactive poker gaming system and method. In the illustrative embodiment, the stand-alone device 110 is an electronic device that has a touch screen video display 112 which acts as a player interface. The illustrative video display player interface 112 embodiment is described in further detail below.

The electronic device 110 includes a dedicated gaming device, a computer having interactive poker gaming software, a personal digital assistant, or any other such device or combination of devices that displays the interactive poker game of the present invention. As shown, the illustrative stand alone device 110 also includes a handle 114 that acts as a player interface component. The function of handle 114 may be similar to the function of a handle in a conventional slot machine.

Additionally, the illustrative stand alone device 110 includes a monetary input component that is configured to receive money or transferable credits, respectively. The illustrative monetary input component 116*a* is a device adapted to receive coins. The illustrative monetary input component 116*b* is a device adapted to receive transferable credits. The transferable credits may be provided by a coupon based system. Other monetary input components may be configured to receive bills, credit cards, debits cards, smart cards, electronic currency and other such means for transferring money or credits.

A coin hopper 118 is used to distribute an award to the player. It shall be appreciated by those skilled in the art that any other components for distributing awards may also be used instead of the coin hopper 118. These other components for distributing awards include a paper coupon, a smart card, a mag stripe card, or any other such means that can record the transfer of money or credits to the player.

Figure 2:
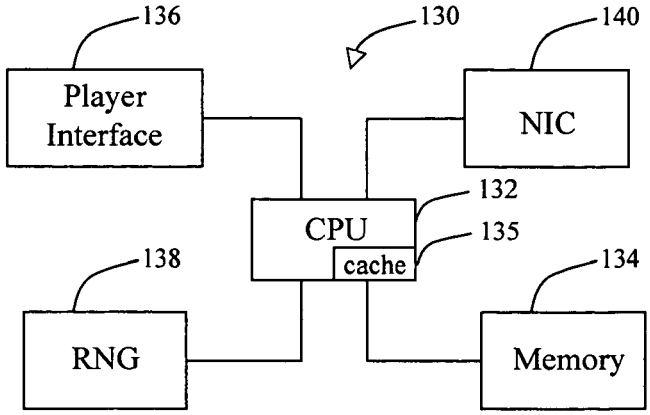
FIG. 2 is an illustrative block diagram of the system for the interactive poker game of FIG. 1.

Referring to FIG. 2 there is shown an illustrative block diagram of the system for the stand alone device 110. The system 130 for the stand alone 110 device includes a logic component that is operatively coupled to internal components that manage the various gaming systems and operations for the interactive poker game. In one embodiment, the electronic device may be a computer in which the logic component is a central processing unit (CPU) 132 and a memory 134 that stores the gaming operations and processes of the interactive poker game. A fast memory cache 135 may also be employed by the CPU 132 to more efficiently access data or software stored in the memory 134. It shall be appreciated by those skilled in the art that the memory cache is a memory that is resident on the CPU 132. Additionally, it shall be appreciated by those skilled in the art that logic component does not have to be a CPU and may include a plurality of logic gates and switches that are either programmed, e.g. a field programmable gate array, or may be an application specific integrated circuit (ASIC).

Additionally, in the illustrative embodiment a player interface 136 is operatively coupled to the CPU 132. As previously described the player interface 136 may include a touch screen video display 112 and a handle 114. Alternatively, the player interface 136 may also include a video display (not shown) having a plurality of switches (not shown) that permit the player to interact with the stand alone device 110. Another alternative player interface 136 is a computer monitor (not shown) having a keyboard or mouse (not shown). The player interface includes a monetary input component as described above or may be configured to store credit or debit card information. Thus, the player interface 136 includes any interface that permits the player to interact with the stand alone system and input desired gaming parameters according to the poker game playing rules.

Thus the processor 132 is in operative communication with the memory 134 and the player interface 136. The processor 132 processes instructions that awards the player a prize when the output of the player interface matches an award identified by the paytable.

In an illustrative embodiment, a random number generator 138 is also operatively coupled to the CPU 132. The random number generator 138 is typically a software module used in the selection of the playing cards during a game session. The game session is defined as a period during which at least one deck of playing cards is dealt to the player. The game session is terminated when all playing cards have been dealt, the player has no more credits, or the player decides to end the game session. The playing cards for the poker game may also be represented as letters, geometric figures, animated figures or any combination thereof. Alternatively, the selection of playing cards may be simulated using system and methods that provide the appearance of a random selection.

In another alternative embodiment, the stand alone device 110 may include a network interface card (NIC) 140 that permits the stand alone device 110 to communicate with a plurality of other devices configured to play the interactive poker game. The NIC 140 uses well known networking protocols to communicate with other networked devices. These well known protocols include Ethernet type protocols, TCP/IP protocols or other such network protocols. Additionally, the stand alone devices maybe networked to provide access to a progressive jackpot. The progressive jackpot is a shared jackpot generated from the network of game devices.

Figure 3:
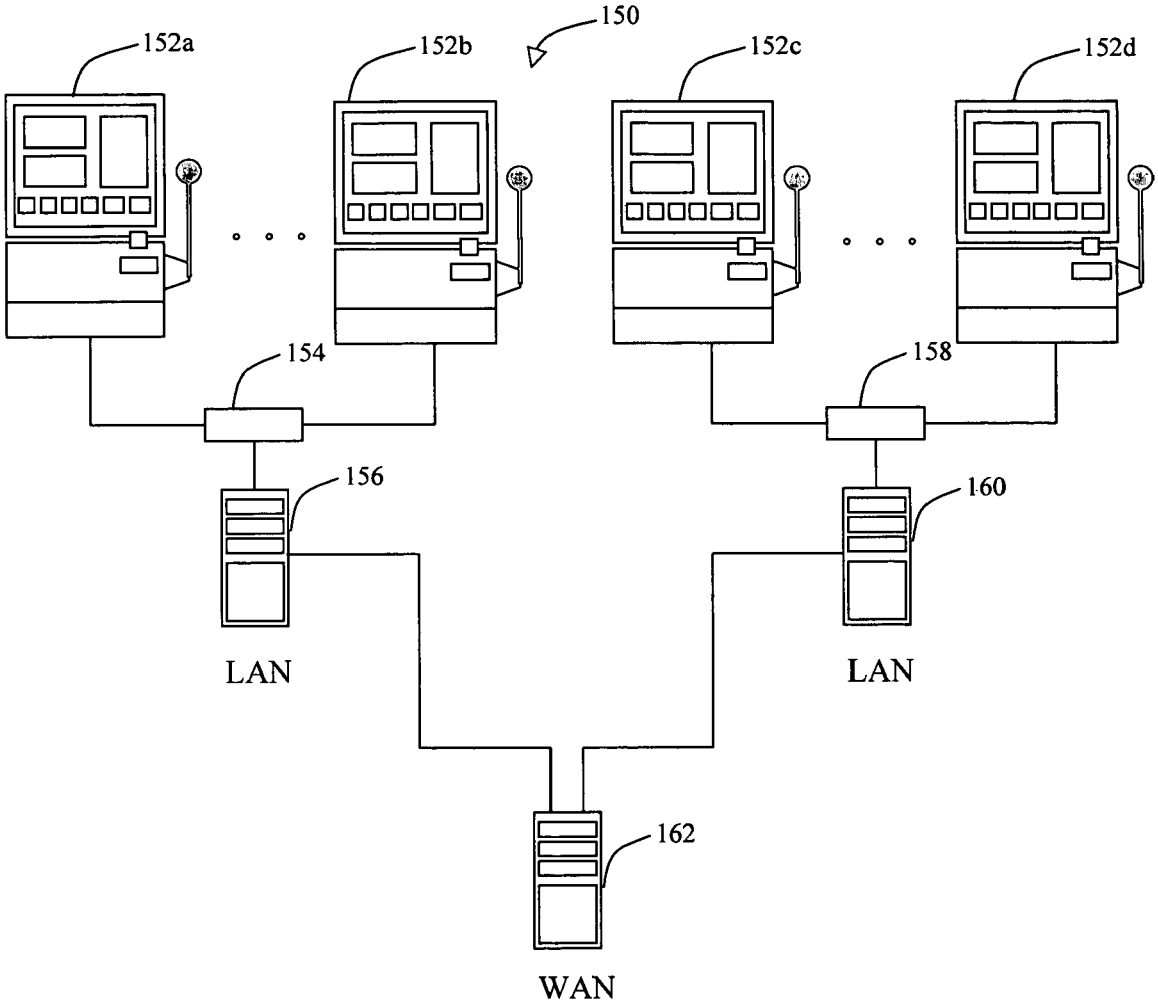
FIG. 3 is an illustrative network system having a plurality of networked systems for the interactive poker game.

Referring to FIG. 3 there is shown an illustrative network system 150 having a plurality of networked devices 152*a* through 152*d*. In the illustrative embodiment the networked devices 152*a* through 152*d* are similar to the stand alone device 110. In the illustrative network system 150, the networked devices 152*a* through 152*b* are operatively coupled to a node 154 that communicates with a local area network (LAN) server 156. Additionally, the networked devices 152*c* through 152*d* are also operatively coupled to a node 158 that is communication with a LAN server 160. The nodes 154 and 168 may be a hub, router, bridge, gateway or any combination thereof that allows communications between the networked devices. It shall be appreciated by those skilled in the art that each LAN may operate independently of the other.

A wide area network (WAN) is created by linking the LANs together. For illustrative purposes only, both LANs communicate with a WAN server 162. For purposes of this disclosure, it can be appreciated that the distinction between a LAN and WAN is primarily geographic in nature. The LAN is geographically limited to a bank of stand alone devices that may be resident on the casino floor. A WAN permits banks of networked devices from different casinos to be networked. A primary purpose for networking the gaming devices is to generate a progressive jackpot. Additional reasons for networking include accounting, diagnostics, player tracking and loyalty programs.

An alternative embodiment to the illustrative network system 150 comprises having the game logic for the interactive poker game resident on a central server. The central server may be either the LAN server 156 or WAN server 162. During a game session, the server then communicates game outputs to the appropriate client, i.e. one of the networked devices 152*a* through 152*d*. Yet another embodiment includes having the central server pick the playing cards to display and deal the playing cards to each of the clients on the network.

Interactive Poker Gaming Method

For purposes of this patent, a game session comprises a plurality of game events. The game session is initiated by having the player express a desire to play a game according to the set of game rules. Each game event that occurs during the game session is subject to a set of game rules. The set of game rules also determines how the player is charged for the game session and how the game session is terminated.

The set of game rules determines the level of player skill that may be applied during a game session. The significance of player skill should not be underestimated. For example if the player adopts a skill based strategy that increases the player's return on investment or payback percentage from 90% to 91%, then the player can play 11% more game sessions. If the player adopts an even better skill based strategy that increases the payback percentage to 92%, then the player can play 25% more game sessions. Thus, by adopting a successful skill based strategy, more game sessions can be played with the same "bankroll" or "wad". A bankroll or wad is the total amount of money the player has allocated to playing the game.

Figure 4:
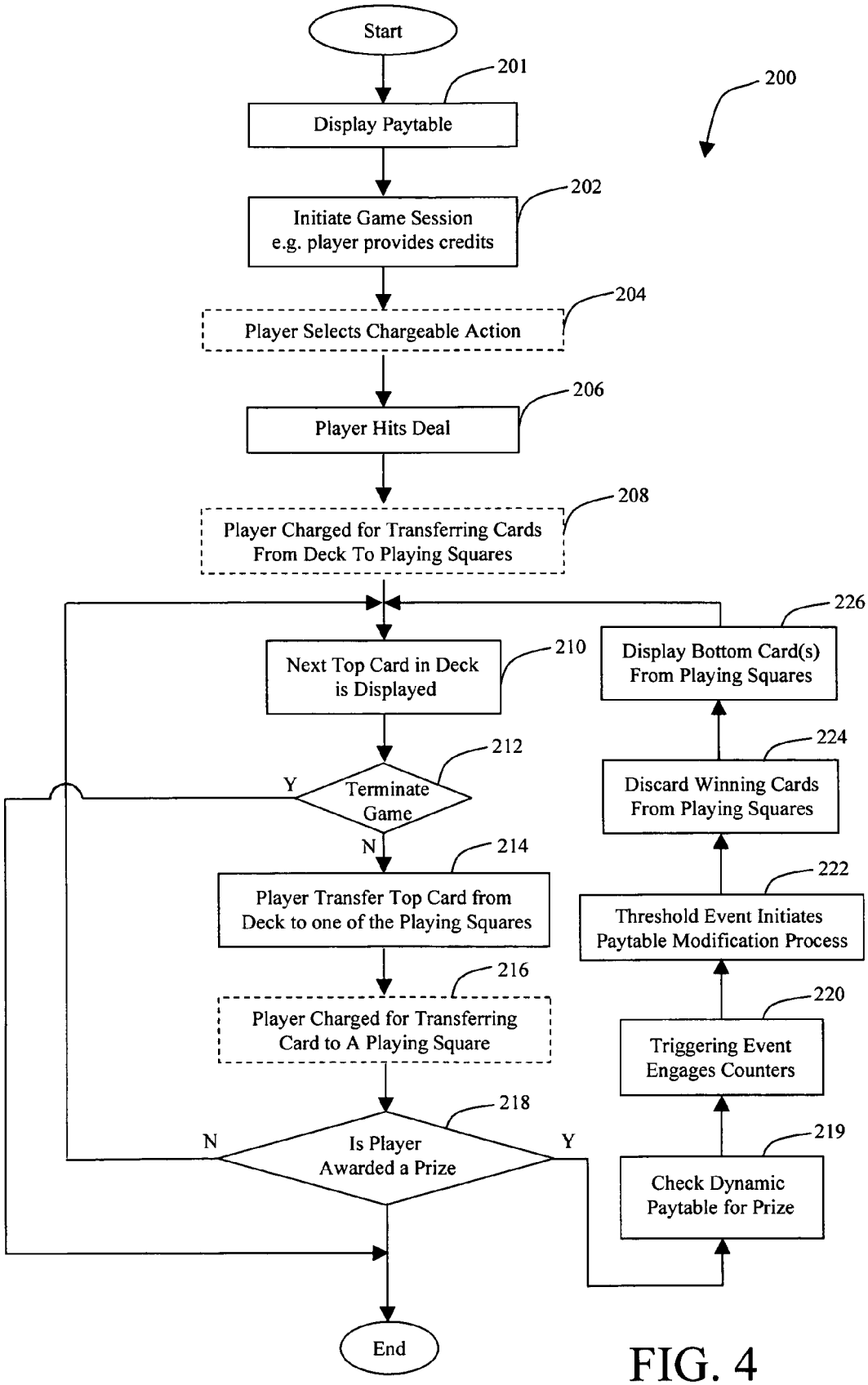
FIG. 4 is a flowchart of a method for playing the interactive poker game.

FIG. 4 is a flowchart for the method of playing the interactive poker game of the present invention. The method 200 for playing the interactive poker game is initiated at block 201 in which a paytable is displayed. The paytable indicates the possible prizes that may be awarded to the player. Preferably, the paytable is a dynamic paytable that is modified during the game session. By way of example and not of limitation a dynamic paytable may be modified as a function of variables that includes: the type of poker combination(s) achieved by the player during a game session, the number of dealt cards, the number of credits wagered, and the remaining number of playing cards with the deck. An illustrative paytable is shown FIG. 5 and FIG. 6 and is described in further detail below. Additionally, a flowchart for the dynamic paytable modification process is described in further detail in FIG. 7 below. Alternatively, the paytable may be a static paytable that does not change during the game session.

The method then proceeds to block 202 in which a game session is initiated. When the game session is initiated the display 112 shows an interactive interface such as the illustrative interface shown in FIG. 9 below. The game session can be initiated with or without the need for game credits. In one illustrative embodiment, the providing of credits includes the inserting of money using coins or currency or the providing of transferable credits derived from coupons, a smart card, a player account, a credit account, or any other such accounts that receive credits or currency. For the "chargeable action" embodiment, the method then proceeds to block 204.

At block 204, the player selects the amount of credits to wager for each "chargeable action". A chargeable action is the amount of credits the player is charged for each card that is transferred from a deck of playing cards to a playing square within the player interface 112. In some instances, a plurality of playing cards may be transferred at one time. In another instance, a single playing card is transferred at one time. By way of example, the player may decide to be charged one credit for each card that is transferred from the deck of playing cards. In the illustrative example, one credit may be worth 10 cents. The chargeable action embodiment then proceeds to block 206.

In an alternative embodiment, hereinafter referred to as the "average bet" embodiment, there is no need for the process performed at block 204. In the average bet embodiment, the credits required for a game session are provided before the game session is initiated. Thus, there is no charge for transferring a card from the deck of playing cards to one the plurality of playing squares. In the average bet embodiment, the gaming method would proceed directly from block 202 to block 206.

At block 206, the game session is initiated when the player hits a "deal" button. The deal button is location on the player interface 112. After hitting the deal button, the cards may be shuffled before the cards are dealt. The shuffling process is intended to provide the appearance that the playing cards within the deck are in a random order. The cards are dealt by transferring cards from the deck to the playing squares. For the average bet embodiment, the player is not charged for the transferring of cards from the deck to one or more of the playing squares. For the chargeable action embodiment, the method then proceeds to process block 208.

For the chargeable action embodiment, at block 208 the player is charged for being dealt playing cards and for transferring each card from the deck to each of the playing squares. In one illustrative embodiment, there are five playing squares configured to receive at least one playing card from the deck of playing cards. The illustrative five-card hand is similar to a conventional five card stud poker hand. In another embodiment, there are seven playing squares for a seven-card poker hand. In the illustrative chargeable action embodiment, a credit meter is decremented and a bet meter is incremented according to the number of credits wagered. The player is charged for each card dealt according to the number of credits identified in block 204. For the illustrative five-card embodiment, a single card from the deck of playing cards is placed in each of the five playing squares. Each card that is dealt is shown face up so that the player may see the value of the card. The playing cards have a point value that corresponds to well known poker rules as described above. The method then proceeds to block 210.

At block 210 the top card in the deck of playing cards is displayed on the player interface 112. At this point in the game session, the player has an opportunity to view all the cards in the playing squares and the top card in the deck. The objective for the player is to achieve a poker card combination that would entitle the player to be awarded a prize according to the paytable displayed in block 201. As an illustrative example, the player may be awarded a prize when the player has one of the following poker combinations: three-of-a-kind, a straight, a flush, a full house, four-of-a-kind, and a straight flush. The method then proceeds to decision diamond 212.

At decision diamond 212, the player game determines whether to terminate the game session or continue the game session. The determination of whether to conclude the game session is based on viewing the playing cards in the playing squares, recalling/viewing the cards beneath the visible playing cards, evaluating the visible top card in the deck, and analyzing the paytable. Based on this initial analysis the player may decided to end the game session and start a new game session with a new set of playing cards. Alternatively, the player may decide to continue the game session and the player then proceeds to process block 214. Additionally, the game session may be terminated for a lack of credits or for some other game rule limitation such as there are no more cards in the deck.

At block 214 the player determines in which playing square to place the displayed top card. The player interface 112 receives a player instruction to place at least one of the playing cards from the deck into one of the plurality of playing squares. As previously noted, the determination of where to place the playing card is dependent on the player strategy for achieving a winning poker combination. The playing card that occupies the playing square where the new card is placed is not discarded. Instead the card that occupies the playing square becomes a bottom card that may be displayed at a future time. Playing cards are only discarded if they generate a winning card combination. For the chargeable action embodiment, the method then proceeds to process block 216.

At block 216, the chargeable action embodiment provides for the player being charged according to the amount of credits identified in block 204. For the chargeable action embodiment, after block 216 the method then proceeds to decision diamond 218. For the average bet embodiment, the process performed at block 216 is not performed and the method proceeds directly from block 214 to decision diamond 218.

At decision diamond 218, it is determined whether a prize is awarded. The type of prize awarded is dependent on the displayed paytable in block 201. As previously mentioned, the player is awarded a prize when the player achieves a winning poker combination. If a prize is awarded to the player then the method proceeds to process block 219.

At process block 219, the paytable is evaluated to determine the prize that is awarded to the player. The prize awarded is dependent on the playing cards that were used to achieve the winning poker combination. An illustrative example of a paytable is shown in FIG. 5 and FIG. 6. As previously mentioned, the paytable may be a dynamic paytable or a static paytable. Recall that the dynamic paytable changes during the game session and the static paytable remains the same during a game session. For the illustrative embodiment a dynamic paytable is employed.

For the dynamic paytable embodiment, the method proceeds to block 220 where a triggering event starts or increments one of a plurality of game history counters. A triggering event occurs each time there is a winning card combination. The game history counters track the number of winning card combinations that were obtained during the game session. The game history counters are cleared for each new game session. The dynamic paytable method then proceeds to block 222.

At block 222, the dynamic paytable modification process is initiated. The paytable modification process is engaged after one or more triggering events. The threshold event is configured to use the game history counters to modify a subsequent prize associated with a subsequent triggering event. The paytable modification process may be based on a single variable such as the last winning poker combination, or may be based on a multiplicity of other variables such as described in the commonly assigned patent application Ser. No. 10/273,440 entitled "Dynamic Paytable for Interactive Games" which is hereby incorporated by reference. After the dynamic paytable has been revised, the method proceeds to process block 224. For the static paytable, the method proceeds directly from process block 219 to process block 224.

At process block 224, the interactive poker game discards the playing cards that make up the winning poker card combination. In one embodiment, the interactive poker game of the present invention does not discard all the cards in one poker hand, and only discards the winning cards. By way of example and not of limitation, for a three-of-a-kind combination, the interactive poker game discards only the three card combination and not the entire five card hand. Alternatively, the interactive poker game discards all the cards in the winning poker hand. Therefore, for a three-of-a-kind combination, all the playing cards in the winning hand are discarded. Note that for a winning poker combination that includes all the playing cards in the hand, e.g. straight, flush, or full house, all playing cards are discarded. The method then proceeds to process block 226.

At process block 226, the cards beneath the discarded cards are displayed in the playing squares. Generally, the method then proceeds to process block 210 where the next top card in the deck is displayed. However, in limited instances the revealed cards may generate a winning card combination without the need to receive the displayed top card in the deck. In these limited instances, the player may be awarded a prize without having to receive the top card. The method then returns to block 210.

Returning to decision diamond 218, if the player is not awarded a prize at decision diamond 218 then the method returns to block 210 to display the next card at the top of the deck.

Whether by way of decision diamond 218 or block 226, the method proceeds to repeat the processes described above. Each of the process blocks that are part of the repetitive process steps is referred to as a "game event". Additionally, a combination of process blocks that are part of the repetitive process steps may also be referred to as a game event. The game session is therefore terminated when the player decides to cash-out, the player has no more available credits, and there are no more cards in the deck.

Referring to FIG. 5 there is shown an illustrative paytable for the interactive poker game having no wild cards. The illustrative paytable 230 shows that the paytable awards 3 credits for a three-of-a-kind poker combination, 4 credits for the straight poker combination, 6 credits for a flush poker combination, 9 credits for a full house poker combination, 25 credits for a four-of-a-kind poker combination, 50 credits for a straight flush poker combination, and 250 credits for a royal flush combination. The prizes awarded are for poker combinations in which there are no wild cards in the deck. The illustrative paytable 230 may be a static paytable that does not change during a game session or may be a dynamic paytable.

Referring to FIG. 6, there is shown an illustrative paytable for an interactive poker game having four wild cards in a single deck having fifty-two cards. For example, deuces may be wild in a poker hand, thus 2♠, 2♣, 2♦, and 2♠ are wild. A wild card may represent any card necessary to generate a winning poker combination; thereby resulting in an increased probability of achieving winning poker combinations. The prizes awarded in paytable 240 reflect the increased probabilities associated with a wild card interactive poker game. The illustrative paytable 240 shows that the paytable awards 1 credit for a three-of-a-kind poker combination, 2 credits for the straight poker combination, 2 credits for a flush poker combination, 3 credits for a full house poker combination, 4 credits for a four-of-a-kind poker combination, 10 credits for a straight flush poker combination, 15 credits for a five of a kind combination, 25 credits for a wild royal flush combination, and 250 credits for a royal flush combination. The illustrative paytable 240 may be a static paytable that does not change during a game session or may be a dynamic paytable.

Figure 7:
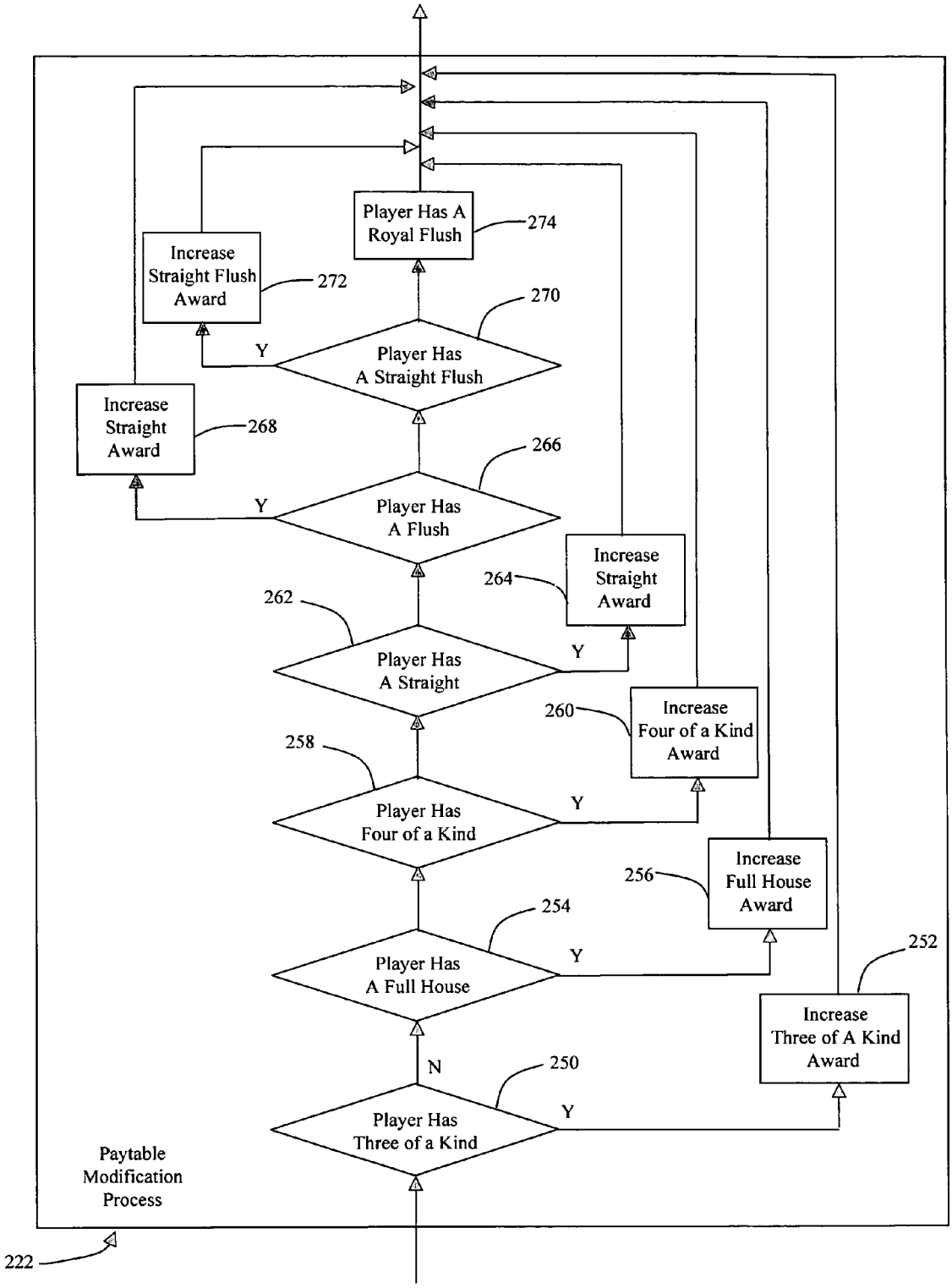
FIG. 7 is a flowchart for an illustrative paytable modification process for the interactive poker game without any wild cards.

Referring to FIG. 7, there is shown a flowchart for an illustrative paytable modification process that generates a dynamic paytable for the interactive poker game. The illustrative paytable modification process 222 determines how the dynamic paytable is to be modified for an interactive poker game having five playing squares and no wild cards. As described in FIG. 4, the paytable modification process is initiated by the triggering event which engages a number of game history counters. The paytable may be modified for a variety of reasons such as increasing the awards at the end of the game session to increase player excitement during the game session. Additionally, the paytable may be modified in a predictable manner so that the player may use skill based knowledge of the paytable change to generate a reasoned player strategy.

In the illustrative paytable modification process 222, at decision diamond 250 the determination is made whether the player has a three-of-a-kind poker combination. If the player has been awarded a prize for a three-of-a-kind combination, then the method proceeds to process block 252. At process block 252, the prize awarded to the player is increased by a fixed amount such as four credits using the game history counters from block 220. Alternatively at process block 252, the prize awarded to the player may be doubled from three credits to six credits. Any other method for increasing the prize awarded to the player may be used, however each of these methods for increasing the prize awarded uses the game history counters of block 220. In an alternative embodiment, the number of credits awarded at process block 252 may also be decreased.

At decision diamonds 254, 258, 262, 266, and 270, the determination is made whether the player has a full house combination, a four-of-a-kind combination, a straight combination, a flush combination, and a straight flush combination, respectively. If the player has a particular poker combination as described in decision diamonds 254, 258, 262, 266, and 270, then the prize awarded for the next particular poker combinations is increased according to process blocks 256, 260, 264, 268, and 272 based on the game history counters. In the illustrative royal flush combination, the process block 274 does not increase the prize award for the next royal flush combination. Although not shown, it shall be appreciated by those skilled in the art that the prize for the next poker combination may be decreased so that a prize for another poker combination may be increased. Thus, the paytable modification process 222 for generating a dynamic paytable includes increasing or decreasing the prizes awarded for any of the winning poker combinations identified by the paytable according the triggering events.

Figure 8:
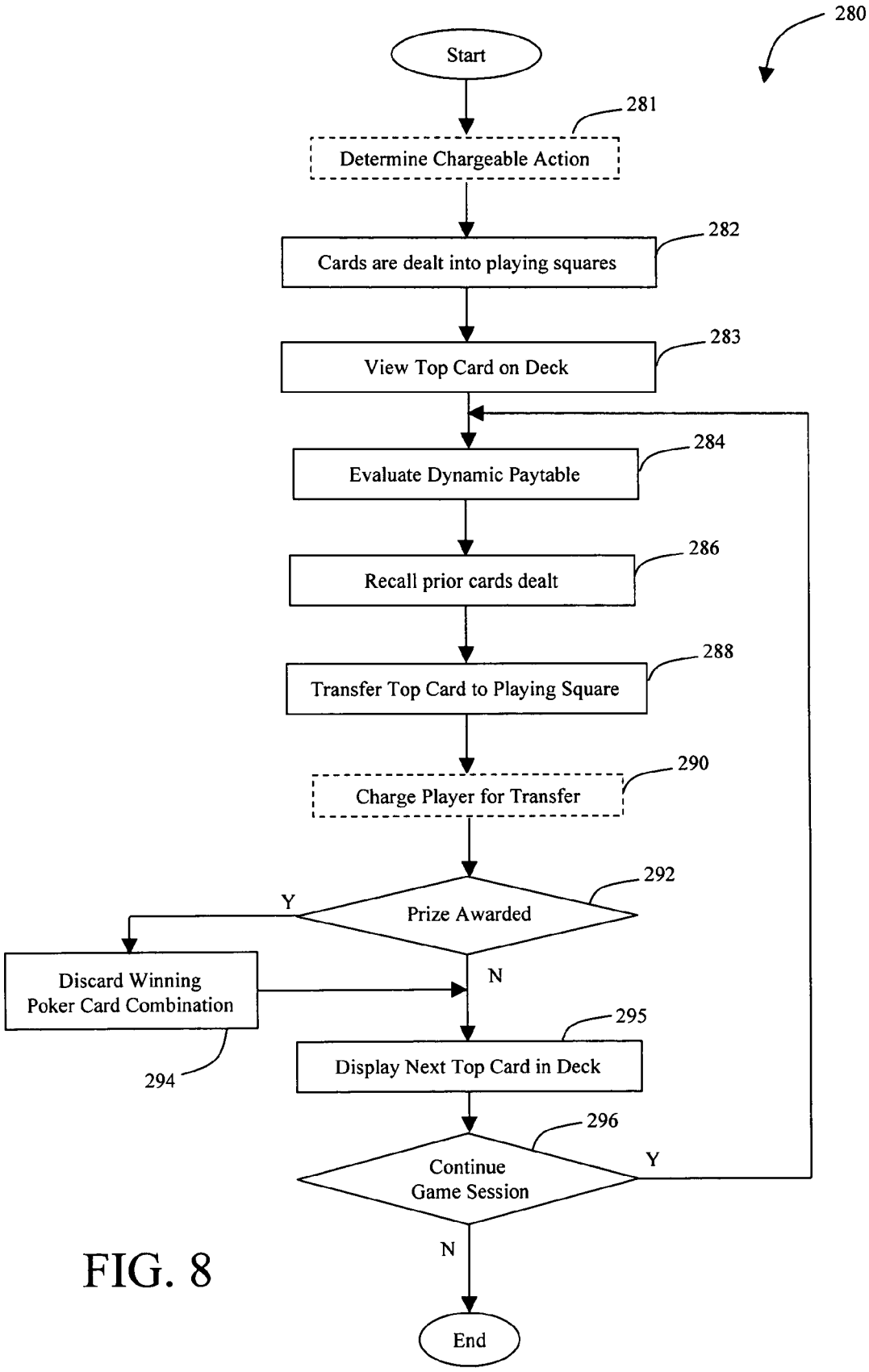
FIG. 8 is a flowchart for the actions taken by an illustrative player during a game session.

Referring to FIG. 8, there is shown a flowchart of steps taken by an illustrative player after the player has transferred credits to the interactive poker game. As shown in process block 281, for the chargeable action embodiment the first step taken by the player is determining the amount to wager for each "chargeable action". Recall that the average bet embodiment does not require this process block.

The method then proceeds to process block 282 where playing cards from the deck are transferred or dealt to each of the playing squares. The player is charged for each playing card transferred from the deck of playing cards to each playing square. The top card from the deck of playing cards is then displayed as described by process block 283.

The player then has the opportunity to perform two skill based tasks that can improve the player's likelihood of winning. The first skill based task is to evaluate the paytable as shown in process block 284 and determine a game strategy based on the displayed playing cards. It shall be appreciated by those of ordinary skill in the art that the paytable may also be evaluated before initiating the game session. Additionally, the step of evaluating the paytable at process block 284 is intended to reflect that the paytable may change during the game session, thus the player must evaluate the paytable to determine whether to change the player strategy or continue with the prior player strategy.

The second skill based opportunity for the player is to recall or analyze the playing cards that have been previously dealt. Process block 286 reflects the step of the player recalling or "counting" the prior cards dealt. The process of "counting" refers to the process of keeping a running count of various cards that have been dealt or remain in the deck to determine a player strategy. The process of "counting" is similar to the process of card counting used in Blackjack. Recall that only winning card combinations are discarded, so the player may have a count for cards within each of the playing squares and a count for the playing cards in the deck. Based on an evaluation of the paytable and the history of playing cards that have been dealt, the player may then select the playing square to transfer the top card from the deck as shown by process block 288.

For the chargeable action embodiment, the method then proceeds to block 290 where the player is charged for each card that is transferred from the deck. The player is charged according to the chargeable action determined in block 281. For the average bet embodiment, there is no charge to the player for transferring the card from the deck to the playing square.

The interactive poker game then makes a determination of whether the player is awarded a prize at decision diamond 292. If a prize is awarded, then the method proceeds to process block 294. At process block 294, the prize is awarded and the winning poker combination is discarded. After it is determined whether the player is awarded a prize, the method proceeds to process block 295 where the next top card in the deck is displayed. After displaying the next top card in the deck, the method proceeds to decision diamond 296 where the player must decide whether to continue the game session. The determination is dependent on the variety of factors described in process blocks 284 and 286 in which the paytable is evaluated, and the history of the cards dealt is evaluated, respectively.

Illustrative Operation of Interactive Poker Game

In the illustrative game sessions described below, a game session is initiated when the player inserts credits into an electronic game device configured to display the interactive poker game and hits the "deal" button. The game session may also be initiated after a prior interactive poker game has been played and the player decides to initiate a new game session with the player's available credits and hits the "deal" button. Alternatively, the game session may be initiated by the player without the use of credits by simply having the player hit the "deal" button.

A game session is terminated when the player decides to end the game session, or when there are no available credits, or when there are no more playing cards available in the deck or shoe. To better understand the interactive poker game described here, the remaining drawings FIG. 9 through FIG. 11 display portions of an illustrative game session.

Figure 9:
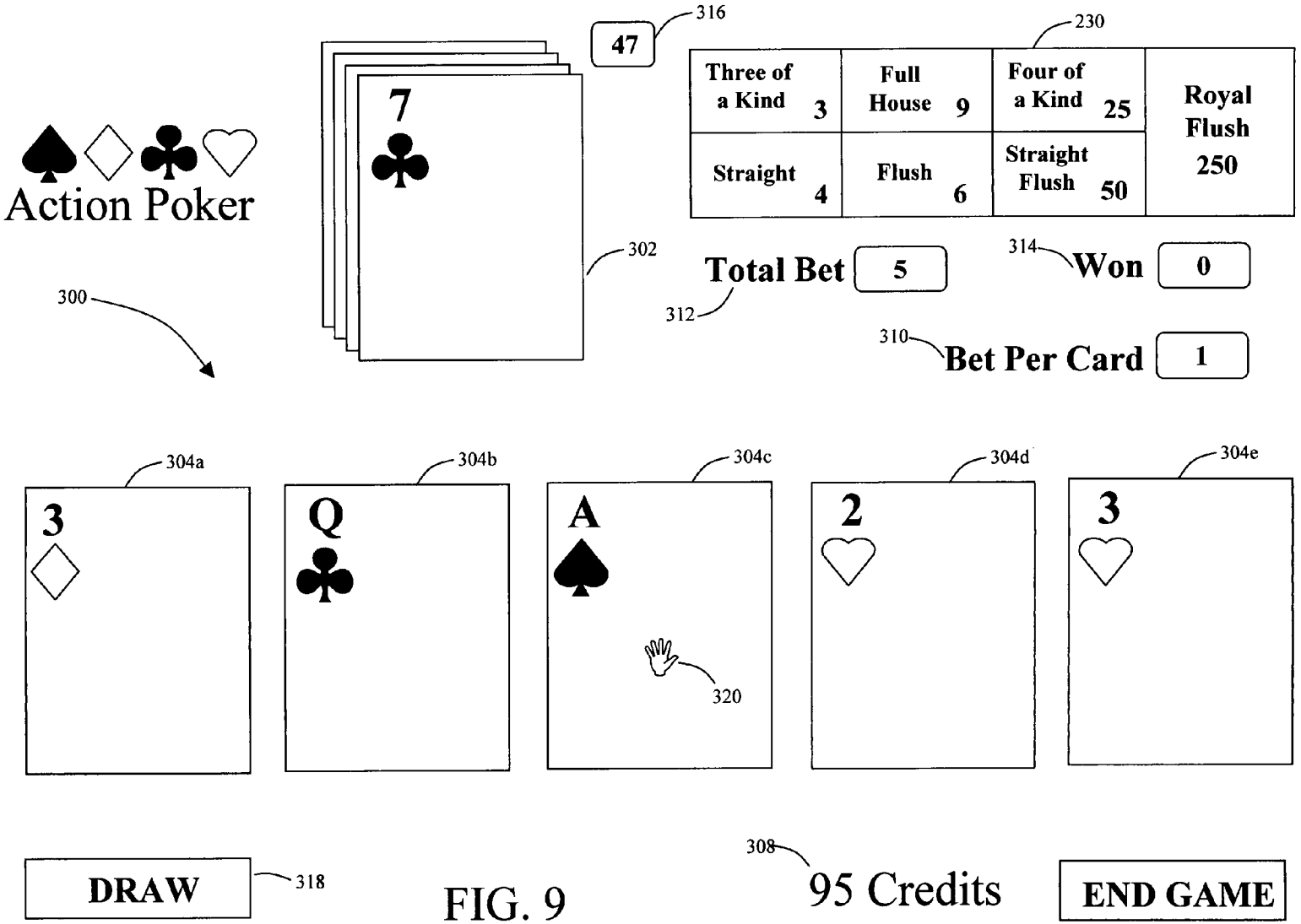
FIG. 9 is an illustrative example of the initial player interface after cards have been dealt into the playing squares.

Referring to FIG. 9 there is shown an illustrative example of the player interface after the interactive poker game has been initiated. In the illustrative embodiment, a game session is initiated when the player provides money or transferable credits as described above and hits the "deal" button. The illustrative player interface 300 is comprised of a deck of playing cards, a plurality of playing squares, a dynamic paytable, and a plurality of counters and meters. It shall be appreciated by those skilled in the art of gaming, that the deck of playing cards may also include a plurality of decks of playing cards or a "shoe" of playing cards.

The deck of playing cards 302 is displayed at the top left portion of the screen. In one illustrative embodiment the deck of playing cards is "electronically" shuffled to generate a deck of mixed playing cards. Below the deck 302 there is shown a plurality playing squares 304*a* through 304*e*. Each of the playing squares 304 is configured to receive at least one of the playing cards from deck 302. The dynamic paytable 230 is displayed at the top right hand corner of the player interface 300.

A plurality of counters and meters are provided to display game activity. A credit meter 308 displays the credits that were received when money or credits were transferred to the game.

For the chargeable action embodiment, a bet per card meter 310 is provided to display the quantity of credits wagered by the player for each card that is transferred from the deck 302 to one of the playing squares 304. As previously described, the transfer of each card from the deck 302 is referred to as the "chargeable action". The chargeable action occurs when the player is charged a predetermined number of credits for each playing card dealt from the deck 320. The player may determine the credits wagered for each chargeable action by incrementing or decrementing the number of credits in the bet per card meter 310. Alternatively, the number of credits wagered in the bet per card meter 310 may be predetermined without any player input. In the average bet embodiment, there is no chargeable action and the player is charged only once at the beginning of the game session. However, for illustrative purposes the chargeable action embodiment is discussed in further detail below. It shall be appreciated by those of ordinary skill in the art that the chargeable action embodiment can be modified to the average bet embodiment.

Above the bet per card meter 310 is a total bet meter 312 and a credit win meter 314. The total bet meter 312 monitors the total number of credits that are bet or wagered during the game session. The credit win meter 314 monitors the total number of credits that are won during the game session. A deck meter 316 monitors the remaining number of cards in the deck 302.

Finally, a "deal" button 318 at the bottom left of the display screen is used to initiate a game session. As previously noted, the game session may be conducted in conjunction with the receipt or transfer of credits.

The illustrative player interface 300 operates on the illustrative touch screen display 112 of FIG. 1. In the illustrative embodiment the interactive poker game is displayed one game session at a time. Alternatively, a plurality of interactive poker game sessions may be displayed on a single monitor or screen.

For illustrative purposes the game session displayed in FIG. 9 is initiated with the player having 100 credits and the player being charged one credit for each card dealt from the deck 302. Although not shown, the 100 credits are initially displayed in the credit meter 308. The player then hits the deal button 318. After hitting the deal button 318, then five cards are dealt from the deck 302. Each card is dealt is placed in one of the playing squares 304*a* through 304*e* such that playing square 304*a* receives a Three of Diamonds, playing square 304*b* receives a Queen of Clubs, playing square 304*c* receives an Ace of Spades, playing square 304*d* receives a Two of Hearts, and playing square 304*e* receives a Three of Hearts. The deck meter 316 is decremented to "47" because of the five cards dealt from deck 302. Finally, the total bet meter 312 is incremented to show that "5" credits have been wagered for each chargeable action of transferring a card from the deck 302 to one of the playing squares 304.

The top card in the deck 320 is a Seven of Clubs. If the player decides to continue the game session, the player must decide in which of the five playing squares to place the Seven of Clubs. For illustrative purposes the player selects playing square 304*c* to receive the Seven of Clubs. The selection of playing square 304*c* is identified by the hand icon 320 that is over the Queen of Clubs.

Figure 10A:
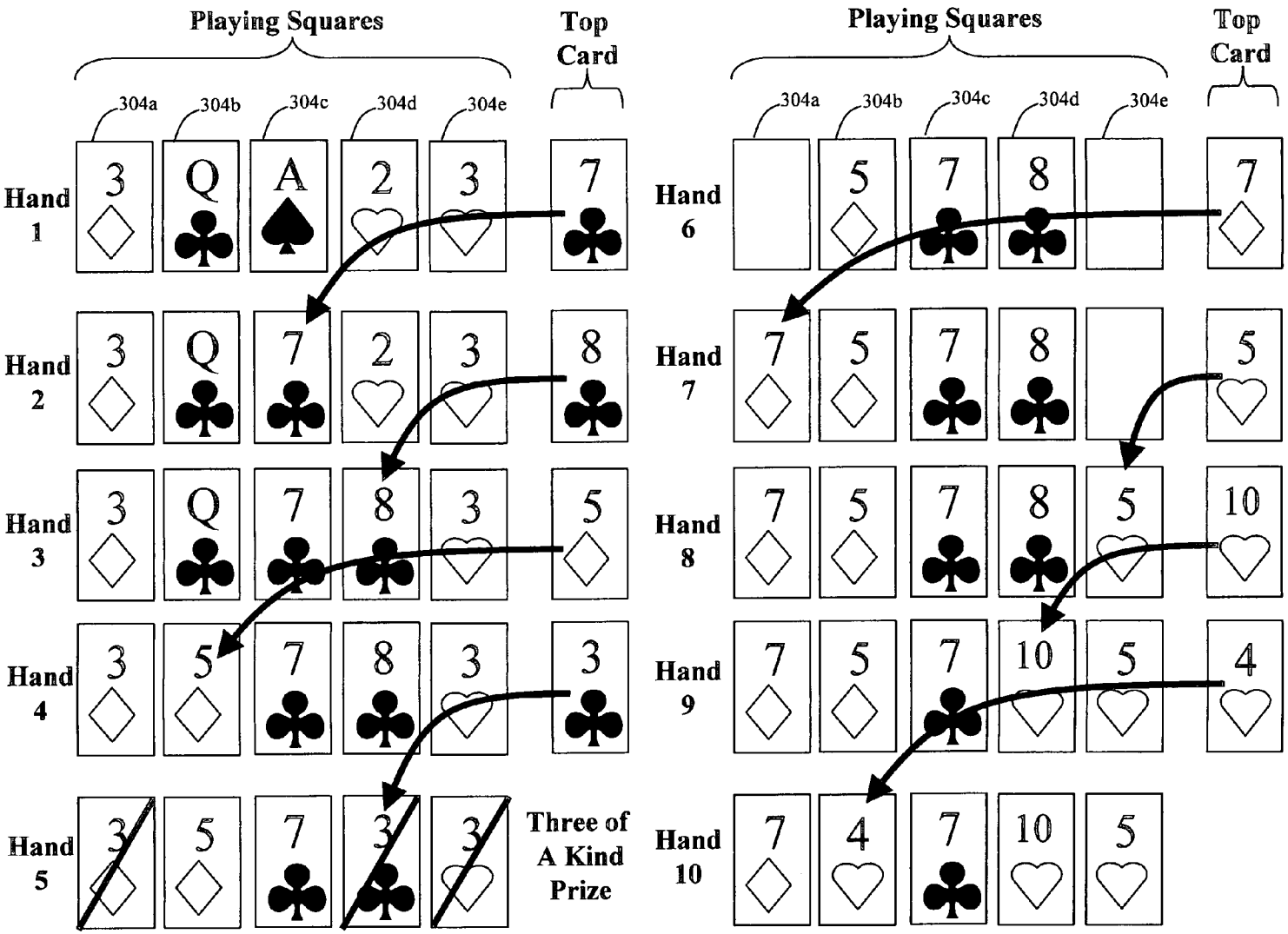
FIG. 10*a* is an illustrative example of a game session in which hand one through hand ten are played.

Referring to FIG. 10*a* there is shown an illustrative example of a game session in which 10 hands are displayed. The first hand displayed is described in FIG. 9 above and is shown again as Hand 1 in FIG. 10*a*. The top card in the deck 302 is shown to the right of the cards in the playing squares 304*a* through 304*e*. During this first hand, the player takes the Seven of Clubs and places it in playing square 304*c*. By taking this action, the player preserves the pair of Threes in playing squares 304*a* and 304*e*.

The second hand that is displayed reflects the transferring of the Seven of Clubs to playing square 304*c* and displays the Eight of Clubs as the top card in deck 302. The player decides to transfer the Eight of Clubs to playing square 304*d* in order to attempt to generate a flush poker combination while preserving the pair of Threes.

During the third hand, a Five of Diamonds is displayed as the top card in the deck 302. The player must now decide whether to continue with attempting to generate a three-of-a-kind poker combination or to generate a flush poker combination. Since the likelihood of getting a three-of-a-kind combination is higher than the likelihood of the player obtaining a flush poker combination, the player decides to place the Five of Diamonds in wagering square 304*b*, and thereby make the Queen of Clubs a bottom card. Placing the Five of Diamonds over the Queen of Clubs also provides the player with an opportunity to generate a straight poker combination with the remaining cards in Hand 3.

During the fourth hand, a Three of Clubs is displayed as the top card in the deck 302. The player can now generate a three-of-a-kind poker combination by placing the Three of Clubs in either playing square 304*b*, 304*c* or 304*d*.

During the fifth hand, the three-of-a-kind combination is generated by placing the Three of Clubs in playing square 304*d*. As a result of generating the three-of-a-kind combination, the player is awarded a three-of-a-kind prize as indicated by paytable 222 in FIG. 9. The paytable 222 indicates that the player is awarded 3 credits for the three of a kind combination. The win meter 314 and credit meter 308 are both updated to reflect the winning credits awarded to the player. The cards that generated the winning three-of-a-kind poker combination are then discarded. Additionally, the paytable 222 is modified according to the paytable modification process 222 in FIG. 7 so that the next prize awarded for a three-of-a-kind poker combination is greater than three credits. For illustrative purposes the next prize awarded for a three-of-a-kind poker combination is programmed to be six credits.

During the sixth hand, the playing squares 304*a* and 304*e* reflect that there are no cards within the playing squares. Since there were no bottom cards within playing square 304*a* and 304*e*, the playing squares are empty. The top card in the deck is a Seven of Diamonds which the player elects to place in wagering square 304*a*.

During the seventh hand, a Five of Hearts is displayed as the top card in the deck 302. The player elects to place the five of hearts in wagering square 304*e*. The player now has a two pair combination. The paytable 230 in FIG. 9 does not award a prize for a two pair poker combination. However, a prize is awarded for a full house combination.

During the eighth hand, a 10 of Hearts is displayed. The player elects to place the Ten of Hearts over the Eight of Clubs to preserve the two pair combination.

During the ninth hand, a Four of Hearts is displayed. Now, the player must make a difficult election. The election is whether to preserve the two pair combination and place the Four of Hearts in playing square 304*d* or to compromise the two pair combinations in order to attempt to generate a flush combination. For illustrative purposes, the player elects to compromise the two pair combination, and places the Four of Hearts in playing square 304*b* making the Five of Diamonds a bottom card.

Figure 10B:
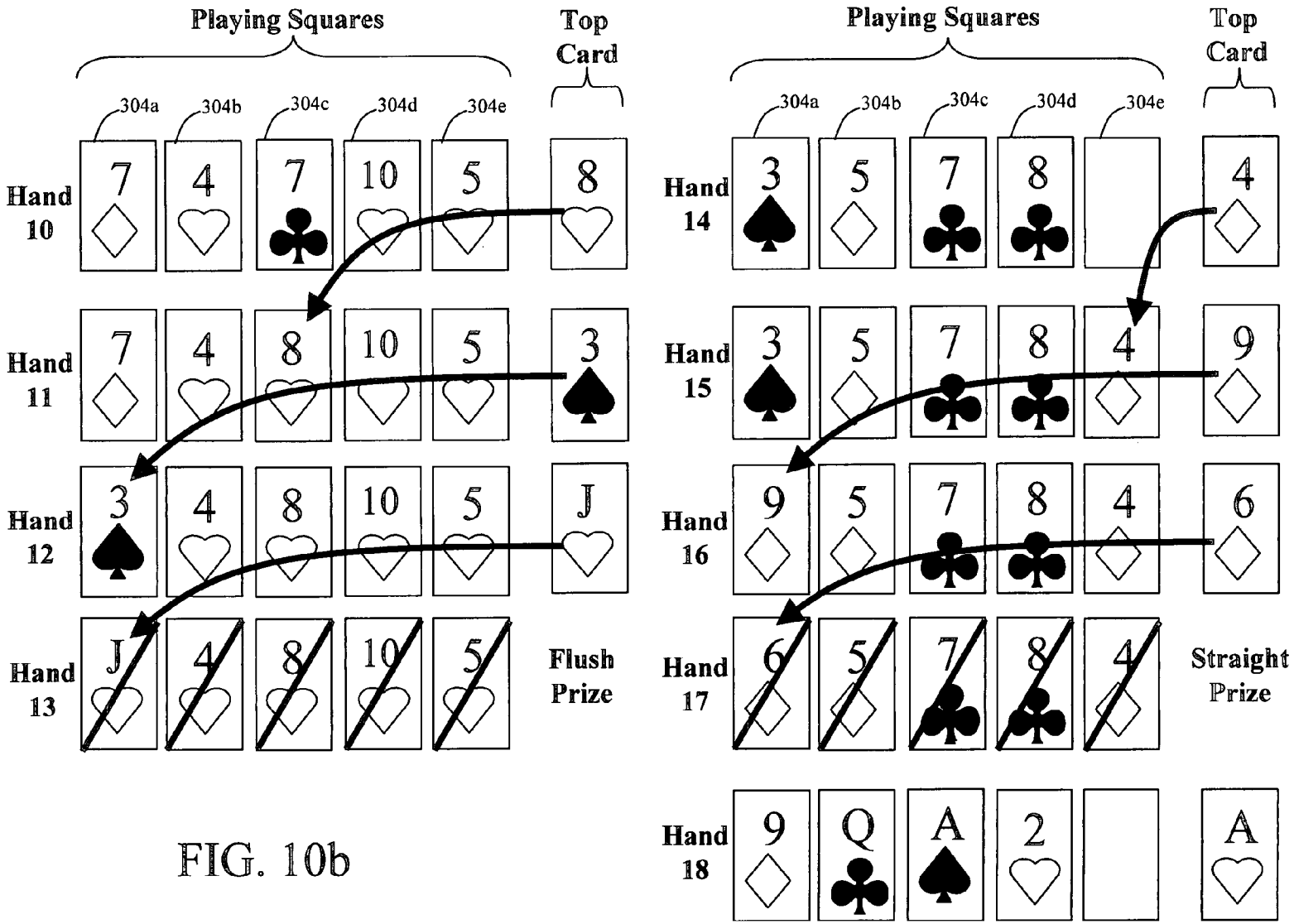
FIG. 10*b* is a continuation of the illustrative game session in FIG. 10 in which hand ten through hand eighteen is played.

Referring to FIG. 10*b* there is shown a continuation of the illustrative game session of FIG. 10 in which the tenth hand to the eighteenth hand is played. During the tenth hand the Eight of Hearts is shown. The player elects to attempt a flush combination and places the Eight of Hearts in playing square 304*c*.

During the eleventh hand, the Three of Spades is shown to be the top card at the top of the deck 302. At this point the player is attempting to achieve flush card combination. Since the player is unable to achieve a hearts flush card combination, the player places the Three of Spades in playing square 304*a*.

During the twelfth hand, the Jack of Hearts is the top card displayed in the deck 302. The Jack of Hearts completes the Hearts flush combination and is placed in playing square 304*a*. During the thirteenth hand the five cards generate a prize of six credits as described in paytable 230. The prize is reflected in the win meter 314 and credit meter 308, which are both updated to reflect the winning credits awarded to the player. The cards that generated the winning flush poker combination are then discarded. Additionally, the paytable 230 is modified according to the paytable modification process 222 in FIG. 7 so that the next prize awarded for a flush poker combination is greater than six credits. For illustrative purposes, the next prize awarded for a flush poker combination is twelve credits.

During the fourteenth hand, the bottom cards beneath the discarded flush card combination are displayed. The bottom cards include a Three of Spades, a Five of Diamonds, a Seven of Clubs, and an Eight of Clubs. Notice that the playing square 304*e* is empty in this hand. The top card in the deck 302 is a Four of Diamonds. The player selects playing square 304*e* to receive the Four of Diamonds. The basis for this strategy may be simply to fill up all the playing square so that the player is entitled to a prize.

During the fifteenth hand, the Nine of Diamonds is the top card in the deck 302. The player elects to place the Nine of Diamonds over the Three of Spades which is in playing square 304*a*. The player strategy for this action is to preserve the possible straight combination and to begin the process of setting up a flush combination.

During the sixteenth hand a six of diamonds is displayed. The player now has a straight combination as displayed in the seventeenth hand. According to paytable 230, the straight combination prize is four credits. The prize is reflected in the win meter 314 and credit meter 308, and the cards that generated the winning straight poker combination are then discarded. Additionally, the paytable 230 is modified according to the paytable modification process 222 in FIG. 7 so that the next prize awarded for a straight poker combination is eight credits.

During the eighteenth hand, the bottom cards beneath the discarded winning straight card combination are displayed. The bottom cards include a Nine of Diamonds, a Queen of Clubs, an Ace of Spades, and a Two of Hearts. Notice that the playing square 304*e* is again empty. The top card in the deck 302 is an Ace of Hearts.

At this point the interactive poker game continues until the end of the game session. As previously described, the game session is terminated when the player decides to end the game session, or the player does not have any available credits for performing the next chargeable action, or when all the cards in the deck have been dealt.

Figure 11:
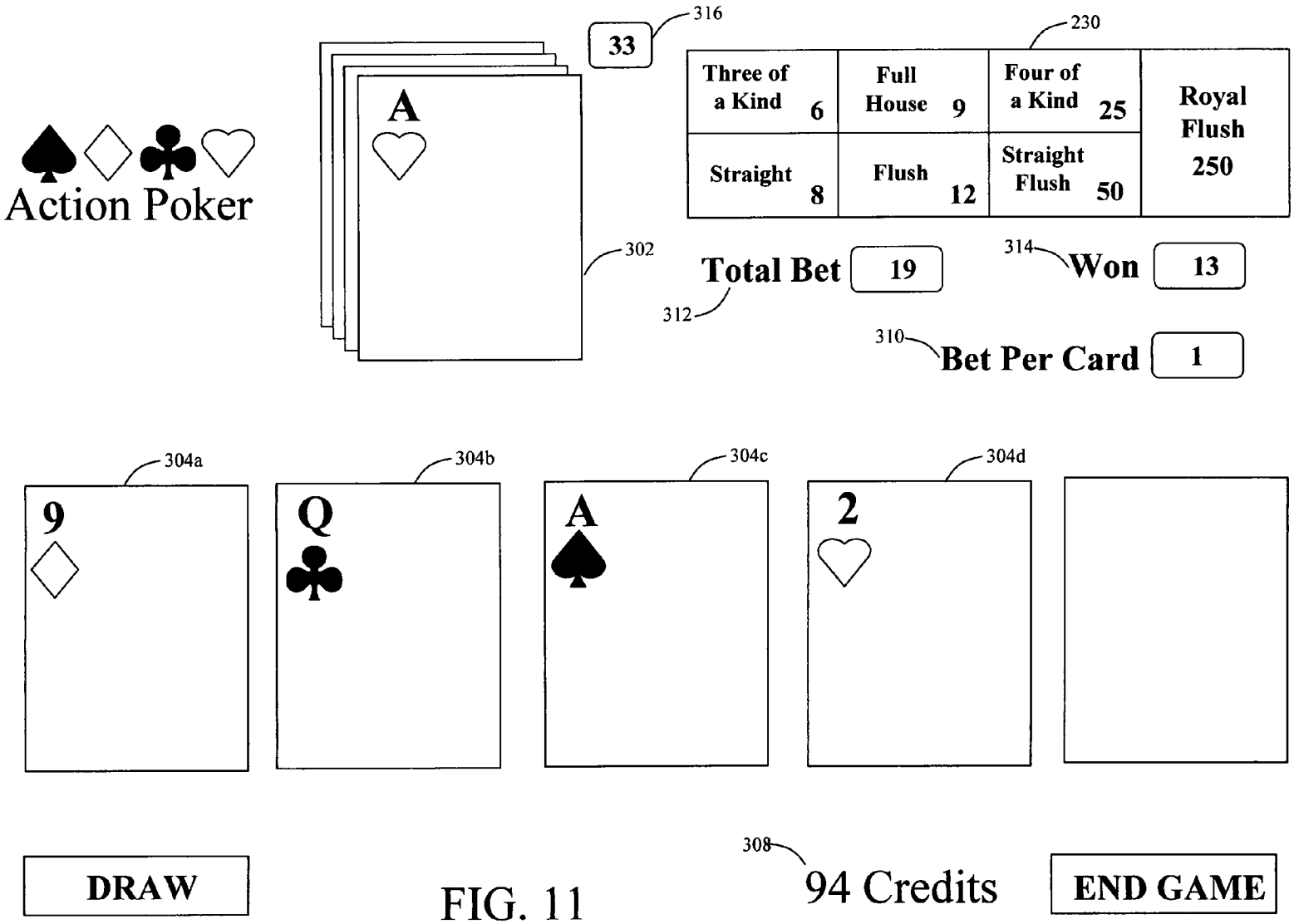
FIG. 11 is an illustrative example of the player interface of the eighteenth hand.

Referring to FIG. 11 there is shown an illustrative player interface of the eighteenth hand. As previously mentioned, the top card displayed is an Ace of Hearts. The Nine of Clubs, Queen of Hearts, Ace of Space and Two of Hearts are displayed in playing squares 304*a*, 304*b*, 304*c* and 304*d*, respectively. The credit meter 308 displays that there are "94" available credits for the player to wager. The credit meter 308 operates according to the following equation:

$$AC=CABGS-CB+CW$$

where;

AC represents the available credits displayed in the credit meter 308;

CABGS represents the credits available at the beginning of the game session;

CB represents the wagered credits identified by the total bet meter 312; and CW represents the credits displayed in the credit win meter 314.

Thus, when the player is awarded an intermediary prize during the game session, the intermediary prize may be transferred to the credit meter 308 so that the player may apply the newly awarded credits towards continuing the game session. The awarding of an intermediary prize adds a heightened level of player interactivity because the player may decide to end the game session after the intermediary prize is awarded. Note, for the average bet embodiment there is no total bet meter and no corresponding CB value.

Additionally, the paytable 230 has been revised to reflect the changes caused by the paytable modification process 222. During the course of the game session, the triggering events were the prizes awarded for the three-of-a-kind combination, the straight combination and the flush combination. As a result of these triggering events, the game history counters for each poker combination is incremented. As a result of an incrementing of the game history counters, subsequent prizes that are awarded to the player are increased. Thus, as the paytable changes, the player changes his game strategy.

For purposes of this patent, "player skill" includes three components: minimal skill, dexterity skill, and knowledge skill. Generally, all games include these components, however, the degree of skill varies for each game. As described above, minimal skill refers to the player having a minimal understanding of the rules of the game and minimal dexterity needed to apply the rules of the game. To play a game according to the game rules, the player must possess minimal skill. Dexterity skill is based on the player's reflexes or coordination. Most games require a degree of dexterity to establish game play. Certain games such as arcade video games or pinball machines are primarily dexterity based skill games. Knowledge skill is based on the player's experience and analytical abilities.

The present poker game uses knowledge skill and provides the player with a variety of opportunities to evaluate a variety of different decisions. By making thoughtful decisions, the player preserves the amount of available credits and can enjoy playing the interactive poker game for a long period of time. Additionally, it is possible for that knowledgeable decisions may increase the likelihood of winning a total prize that exceeds the amount wagered. In making knowledge based skill decisions, the player's evaluation includes evaluating the history of cards dealt, the paytable, the cards in the playing squares and the likelihood of the future cards dealt. These decision making opportunities provide the player with an opportunity to preserve winnings and minimize losses. By preserving winnings and minimizing losses, the player can enjoy playing the interactive poker game for a much longer period of time. If the player did not possess knowledge based skill to preserve winnings and minimize losses, the player would quickly spend his available credits.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the illustrative examples given.

What is claimed is:

1. A method for playing an interactive poker game with a deck of playing cards, comprising:

initiating a game session;

providing a plurality of playing squares configured to receive cards drawn from said deck;

providing each dealt playing card with a value that corresponds to each of said playing cards face value;

performing a plurality of game events wherein each game event comprises drawing one or more playing cards from said deck and permitting a player to transfer each of said playing cards to one of said plurality of playing squares;

performing a plurality of chargeable actions wherein each chargeable action comprises charging said player at least one credit for drawing said one or more playing cards from said deck and transferring said one or more playing cards to said plurality of playing squares;

permitting said player to place a plurality of cards in each playing square wherein only each top card associated with each playing square is used to determine if a winning card combination is generated; and awarding said player one or more prizes according to a dynamic paytable.

2. The method of claim 1 further comprising discarding said winning card combination and revealing each bottom card for each of said playing squares.

3. The method of claim 1 wherein said game session is initiated by said interactive poker game receiving one or more credits.

4. The method of claim 1 further comprising displaying a top card from said deck of playing cards and awaiting a player instruction to transfer said top card to one of said plurality of playing squares.

5. The method of claim 4, wherein prior to receiving said player instruction, said player has an opportunity to evaluate a plurality of different actions.

6. The method of claim 1 further comprising permitting said player to terminate said game session after each game event.

7. The method of claim 1 further comprising providing five playing squares.

8. The method of claim 1 further comprising providing seven playing squares.

9. The method of claim 1, wherein said dynamic paytable further comprises a plurality of triggering events wherein each triggering event is associated with said winning card combination, said triggering event configured to start at least one game history counter, and a threshold event that is engaged after one or more triggering events, said threshold event configured to use said game history counter to modify a subsequent prize associated with a subsequent triggering event.

10. The method of claim 9 wherein said winning poker hand is a Three-of-a-Kind combination.

11. The method of claim 9 wherein said winning poker hand is a Straight combination.

12. The method of claim 9 wherein said winning poker hand is a Flush combination.

13. The method of claim 9 wherein said winning poker hand is a Full House combination.

14. The method of claim 9 wherein said winning poker hand is a Four-of-a-Kind combination.

15. The method of claim 9 wherein said winning poker hand is a Straight Flush combination.

16. The method of claim 9 further comprising providing at least one wild card within said deck of playing cards.

17. The method of claim 15 wherein said winning poker hand is a Five-of-a-Kind combination.

18. The method of claim 15 wherein said winning poker hand is a Wild Royal Flush.

19. The method of claim 1 further comprising networking a plurality of said interactive games.

20. An interactive poker gaming system, comprising:

a player interface configured to display, at least one deck of playing cards, and a plurality of playing squares wherein each of said plurality of playing squares is configured to receive one or more cards from said at least one deck of playing cards, wherein only each to card associated with each playing square is used to determine whether a winning card combination has been generated;

a credit meter for monitoring a plurality of available credits that are wagered for each chargeable action in which at least one credit is charged to a player each time one of said playing cards is transferred from said deck to one or said plurality of playing squares;

a processor in operative communication with said player interface and said credit meter, said processor configured to determine when to award said player a prize; and a memory communicatively coupled to said processor, said memory configured to store a dynamic paytable that identifies prizes awarded for having said player obtain a winning card combination.

21. The system of claim 20 wherein said processor is configured to discard said playing cards that generate said winning card combination.

22. The system of claim 20 further comprising a total bet meter configured to monitor credits charged to said player each time one of said playing cards is transferred from said deck to one of said plurality of winning card combinations.

23. The system of claim 20 further comprising a termination button configured to permit said player to terminate said game session after one of said plurality of cards is dealt.

24. The system of claim 20 further comprising a network interface card communicatively coupled to said processor, said network interface card configured to permit said electronic gaming system to communicate with another networked device.

25. A method for playing an interactive poker game with a deck of playing cards, comprising:

initiating a game session;

charging a player one or more credits for initiating said game session;

providing a plurality of playing squares configured to receive cards drawn from said deck;

providing each dealt playing card with a value that corresponds to each of said playing cards face value;

performing a plurality of game events wherein each game event comprises drawing one or more playing cards from said deck and permitting said player to transfer each of said playing cards to one of said plurality of playing squares;

permitting said player to place a plurality of cards in each playing square wherein only each top card associated with each playing square is used to determine if a winning card combination is generated; and awarding said player one or more prizes according to a dynamic paytable, wherein said dynamic paytable further comprises, a plurality of triggering events wherein each triggering event is associated with said winning card combination, said triggering event configured to start at least one game history counter, and a threshold event that is engaged after one or more triggering events, said threshold event configured to use said game history counter to modify a subsequent prize associated with a subsequent triggering event.

26. The method of claim 25 further comprising discarding said winning card combination and revealing each bottom card for each of said playing squares.

27. The method of claim 25 wherein said game session is initiated by said interactive poker game receiving one or more credits.

28. The method of claim 25 further comprising displaying a top card from said deck of playing cards and awaiting a player instruction to transfer said top card to one of said plurality of playing squares.

29. The method of claim 28, wherein prior to receiving said player instruction, said player has an opportunity to evaluate a plurality of different actions.

30. The method of claim 25 further comprising permitting said player to terminate said game session after each game event.

31. The method of claim 25 further comprising providing five playing squares.

32. The method of claim 25 further comprising providing seven playing squares.

33. The method of claim 25 wherein said winning poker hand is a Three-of-a-Kind combination.

34. The method of claim 25 wherein said winning poker hand is a Straight combination.

35. The method of claim 25 wherein said winning poker hand is a Flush combination.

36. The method of claim 25 wherein said winning poker hand is a Full House combination.

37. The method of claim 25 wherein said winning poker hand is a Four-of-a-Kind combination.

38. The method of claim 25 wherein said winning poker hand is a Straight Flush combination.

39. The method of claim 25 further comprising providing at least one wild card within said deck of playing cards.

40. The method of claim 39 wherein said winning poker hand is a Five-of-a-Kind combination.

41. The method of claim 39 wherein said winning poker hand is a Wild Royal Flush.

42. The method of claim 25 further comprising networking a plurality of said interactive games.

43. An interactive poker gaming system, comprising:

a player interface configured to display, at least one deck of playing cards, and a plurality of playing squares wherein each of said plurality of playing squares is configured to receive one or more cards from said at least one deck of playing cards, wherein only each top card associated with each playing square is used to determine whether a winning card combination has been generated;

a credit meter configured to monitor a plurality of available credits that are wagered at the beginning of each game session;

a processor in operative communication with said player interface and said credit meter, said processor configured to determine when to award said player a prize; and a memory communicatively coupled to said processor, said memory configured to store a dynamic paytable that identifies prizes awarded for having said player obtain a winning card combination, said dynamic paytable further comprises, a plurality of triggering events wherein each triggering event is associated with said winning card combination, said triggering event configured to start at least one game history counter, and a threshold event that is engaged after one or more triggering events, said threshold event configured to use said game history counter to modify a subsequent prize associated with a subsequent triggering event.

44. The system of claim 43 wherein said processor is configured to discard said playing cards that generate said winning card combination.

45. The system of claim 43 further comprising a total bet meter configured to monitor credits charged to said player each time one of said playing cards is transferred from said deck to one of said plurality of winning card combinations.

46. The system of claim 43 further comprising a termination button configured to permit said player to terminate said game session after one of said plurality of cards is dealt.

47. The system of claim 43 further comprising a network interface card communicatively coupled to said processor, said network interface card configured to permit said electronic gaming system to communicate with another networked device.

* * * * *